US005526007A

United States Patent [19]

Murakami et al.

[11] Patent Number: 5,526,007

[45] Date of Patent: Jun. 11, 1996

[54] WIRE ANTENNA FOR CIRCULARLY POLARIZED WAVE

[75] Inventors: Yuichi Murakami, Chiryu; Kiyokazu Ieda, Toyota, both of Japan

[73] Assignee: Aisin Seiki Kabushiki Kaisha, Kariya, Japan

[21] Appl. No.: 376,091

[22] Filed: Jan. 20, 1995

Related U.S. Application Data

[63] Continuation of Ser. No. 35,705, Mar. 23, 1993, abandoned.

[30] Foreign Application Priority Data

Mar. 26, 1992 [JP] Japan ..... 4-068565

[51] Int. Cl.[6] ..... H01Q 11/14

[52] U.S. Cl. ..... 343/741

[58] Field of Search ..... 343/741, 742, 343/743, 867; H01Q 11/14, 9/26, 21/24, 21/26

[56] References Cited

U.S. PATENT DOCUMENTS

| | | | |
|---|---|---|---|
| 2,518,736 | 8/1950 | Wheeler | 343/741 |
| 2,842,765 | 7/1958 | Schmitt | 343/742 |
| 3,184,746 | 5/1965 | Chatelain | 343/742 |
| 3,261,019 | 7/1966 | Lundy | 343/742 |
| 3,573,832 | 4/1971 | Callaghan | 343/742 |
| 4,518,965 | 5/1985 | Hidaka | 343/742 |
| 4,922,261 | 5/1990 | O'Farrell | 343/742 |

FOREIGN PATENT DOCUMENTS 61-252701 10/1986 Japan .

*Primary Examiner*—Michael C. Wimer
*Attorney, Agent, or Firm*—Sughrue, Mion, Zinn, Macpeak & Seas

[57] ABSTRACT

A wire antenna for circularly polarized wave has a loop conductor that is composed of an outer element 3*a* of one turn and an inner element 3*b* of three-fourths turn. The antenna has an overall length of approximately 7/4 wave length and is a 7/4 turn loop of a rectangular shape with opposite ends separated. Feeding terminals 2*a* and 2*b* as feeding points are positioned at one turn point of the loop conductor.

10 Claims, 9 Drawing Sheets

WIRE ANTENNA FOR CIRCULARLY POLARIZED WAVE

This is a continuation of application Ser No. 08/035,705, filed Mar. 23, 1993, abandoned.

BACKGROUND OF THE INVENTION

1. Field of the Invention

This invention relates to a wire antenna for circularly polarized wave, particularly to a wire antenna for circularly polarized wave that has a planar and thin shape as a whole.

2. Description of the Related Art

Conventionally known antennas for circularly polarized wave are a helical antenna, a cross dipole antenna, a patch antenna, etc. In recent years, the antenna for circularly polarized wave has been being required in mobile communications. There is a need for the antenna to be a shape without projections on its outside.

A patch antenna utilizing a dielectric substrate is known as an antenna serving for the above use. However, an expensive polytetrafluoroethylene (Teflon, Registered Trademark) substrate or the like is necessary in order to make the antenna thin, small and light. Therefore, the antenna satisfies requirements but is very costly. The helical antenna is a wire antenna, but is hard to be practised into a thin type. The cross dipole antenna needs two feed points, so that a power distributor and a phase shifter are indispensable, thus making its costs high.

Japanese Laid Open Patent Publication No. 61-252701 shows an art related to such antennas for circularly polarized wave.

This publication discloses an antenna in which a branch conductor of a length of about one fourth λ (lambda) is arranged parallel to a loop conductor of an overall length of about one λ (lambda). It generates circularly polarized waves by adjusting a gap between the conductors.

Japanese Laid Open Patent Publication No. 2-214304 shows another art related to such antennas for circularly polarized wave.

This publication discloses an antenna in which an earth plate is disposed on a rear surface of a dielectric substrate and in which a circular loop conductor is provided on a surface of the dielectric substrate. Particularly, a central conductor of a feeding coaxial line is linearly connected with an L-shaped element fitted on the loop conductor, and an outer housing conductor is linearly connected with the earth plate.

The antennas for curcularly polarized wave shown in the publications 61-252701 and 2-214304 are three-dimensional.

According to an experiment, in the antenna of 61-252701, a gap between the loop conductor and the branch conductor as well as a height from a reflecting plate are important. Unless the above dimensional accuracy is strictly kept, the antenna cannot maintain a good characteristic. Moreover, there is a practical problem in consideration of mechanical strength of a structure for standing the conductors on the reflecting plate, specially in view of vibration when mounted on a car.

On the other hand, in the antenna of 2-214304, the dielectric substrate is indispensable for its structure. Generally, the dielectric substrate of good high-frequency characteristic is expensive, so that it is difficult to decrease costs. If the antenna is constructed in a wire shape, a perturbation element must be added on a point of the loop, thus needing a soldering step or the like.

SUMMARY OF THE INVENTION

In view of the above, taking notice of low prices of materials of a wire antenna, it is an object of the invention to provide a wire antenna for circularly polarized wave that is made of inexpensive components and has a shape suitable for mobiles.

In accordance with one preferred mode of the invention, there is provided a wire antenna for circularly polarized wave that has one turn element and a three-fourths turn element. The antenna is composed of a loop conductor of an overall length of seven-fourths (lambda) and a loop of seven-fourths turn. The loop conductor has a rectangular shape with opposite ends separated. A feeding point is positioned at one turn point of the loop conductor.

Further objects and advantages of the invention will be apparent from the following description, reference being had to the accompanying drawings, wherein preferred embodiments of the invention are clearly shown.

BRIEF DESCRIPTION OF THE DRAWINGS

FIG. 9(*b*) is a front view showing a balanced system of one embodiment of a wire antenna for circularly polarized wave of the invention.

FIG. 9(*c*) is a front view showing an unbalanced system of one embodiment of a wire antenna for circularly polarized wave of the invention.

DETAILED DESCRIPTION OF THE PREFERRED EMBODIMENTS

Figure 1:
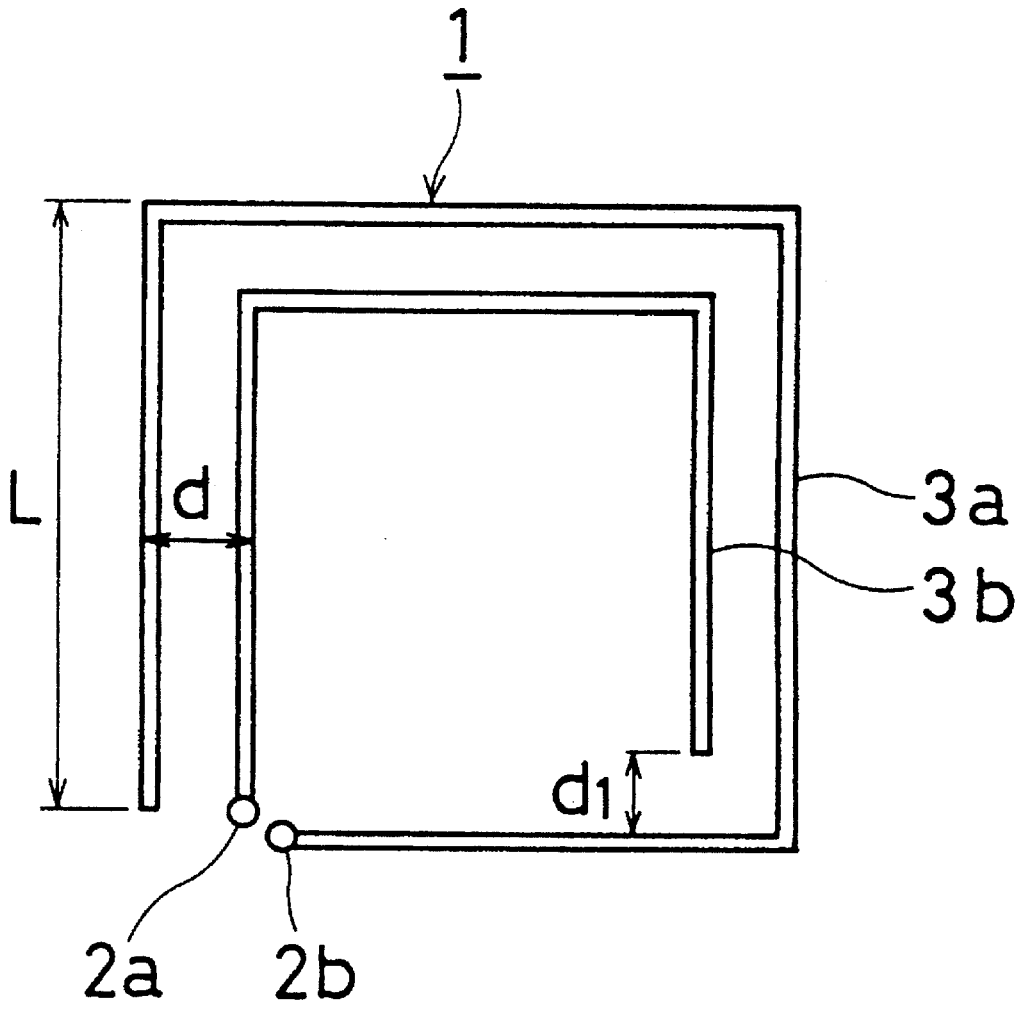
FIG. 1 is a front view showing one embodiment of a wire antenna for circularly polarized wave of the invention.

Referring to the drawings, wherein like reference characters designate like or corresponding parts throughout the several views, a preferred mode of a wire antenna for circularly polarized wave of the invention will be described hereafter.

Referring to FIG. 1, the present embodiment of the antenna is structured into a loop of seven-fourths turn and has an overall length of seven-fourths wave length λ0 at free space. A feeding point thereof is positioned at a point of one turn. Namely, when feeding terminals 2*a* and 2*b* are supplied parallel with power, elements 3*a* and 3*b* constituting a loop conductor radiate circularly polarized waves. The outer element 3*a* is a rectangular loop of one turn, while the inner element 3*b* is a rectangular loop of three-fourths turn. There is held a constant distance d between parallel sides of the elements 3*a* and 3*b*. There is provided a fixed distance d1 between a three-fourths point (leading end) of the inner element 3*b* and the outer element 3*a*. The present embodiment uses a piano wire of a loop wire diameter of 0.3 mm, while setting a length L=0.27λ0, the distance d=0.016λ0, the distance d1=0.026λ0. Here, the λ0 shows a free space wave length.

Figure 2:
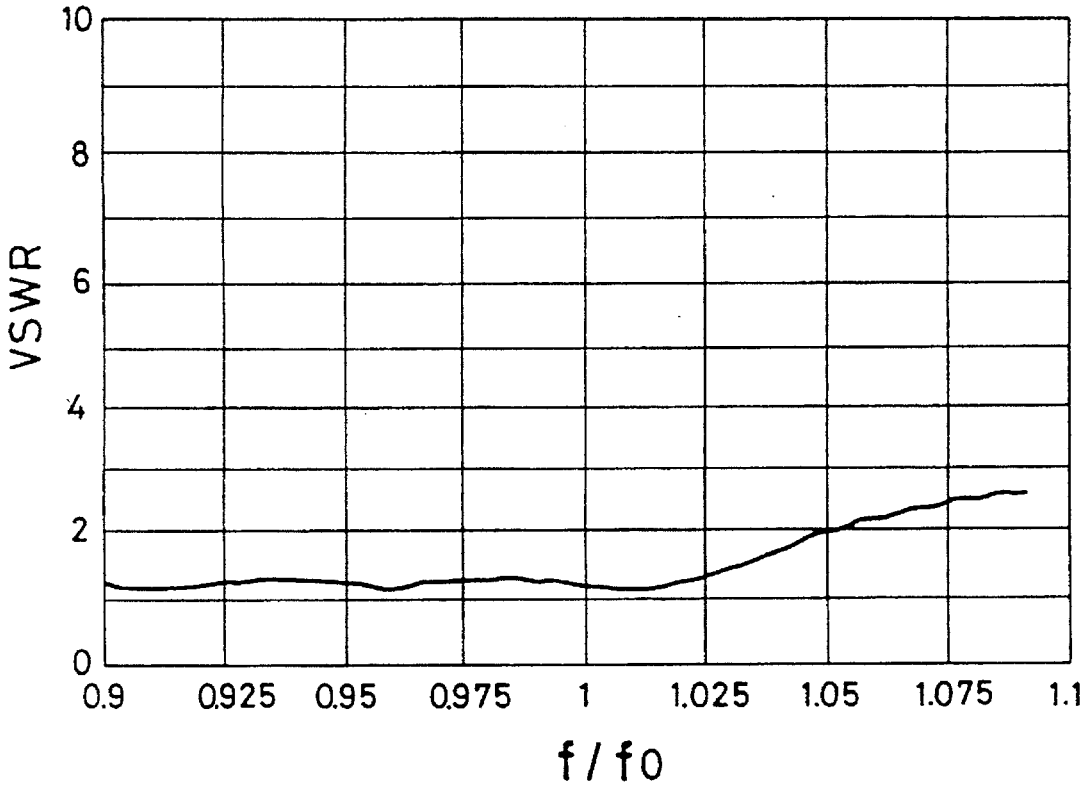
FIG. 2 is a graph showing a VSWR characteristic of a wire antenna for circularly polarized wave of the invention.
Figure 3:
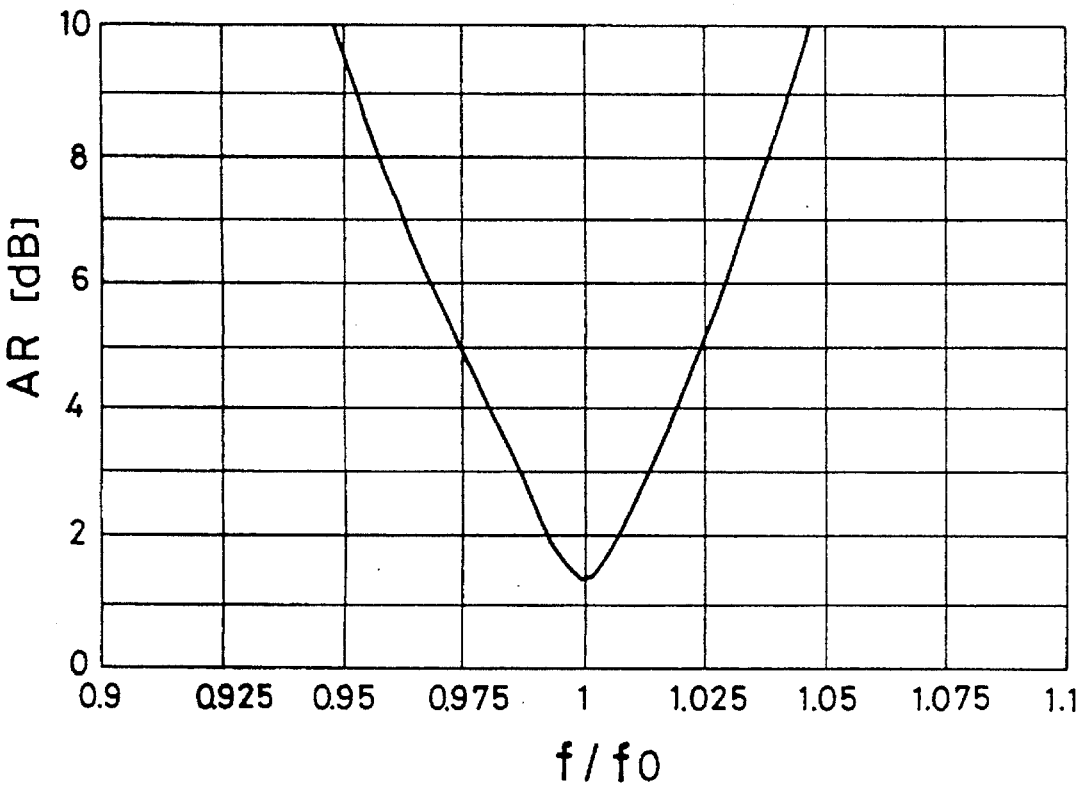
FIG. 3 is a graph showing an axial ratio characteristic of a wire antenna for circularly polarized wave of the invention.
Figure 4:
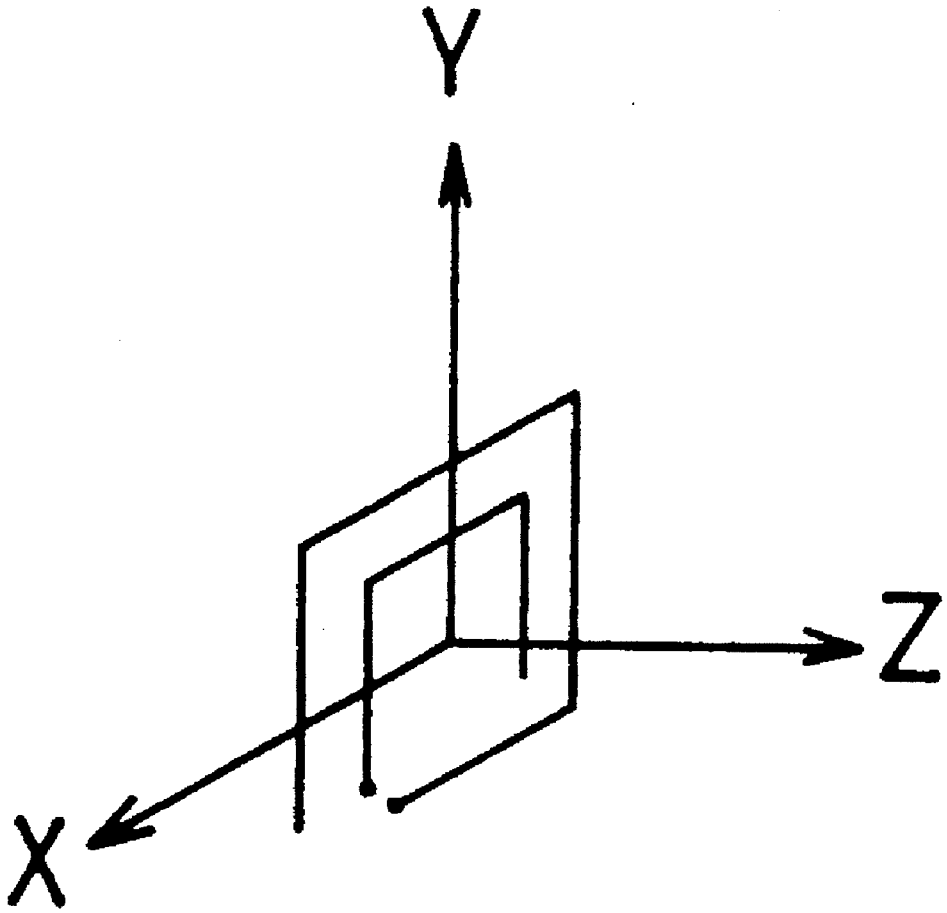
FIG. 4 is a perspective view showing a measurement coordinate system of a wire antenna for circularly polarized wave of the invention.
Figure 5:
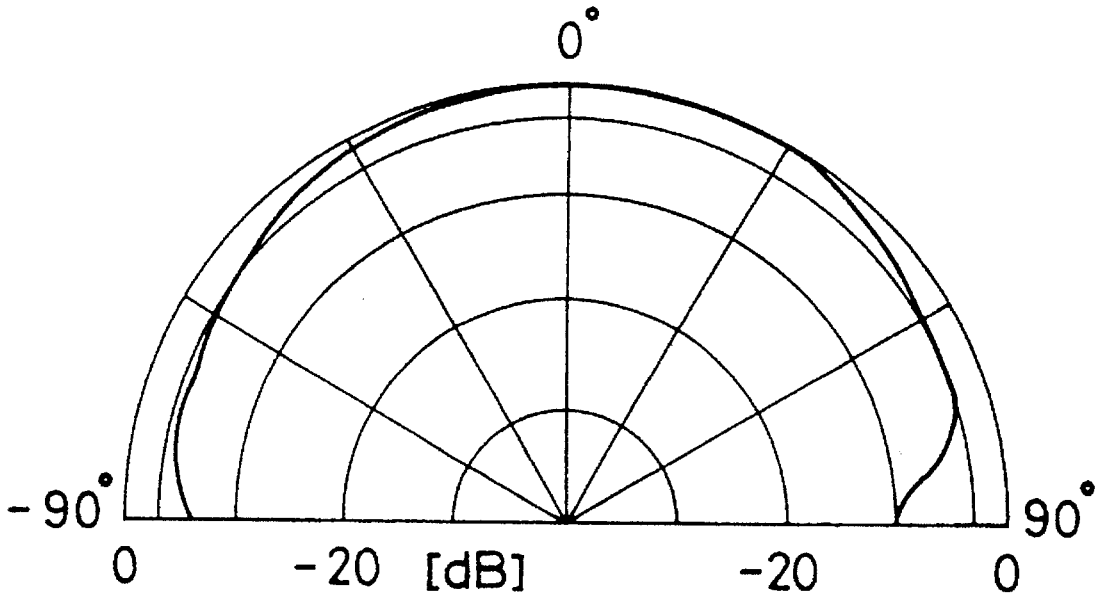
FIG. 5 is a graph showing a radiation pattern of X-Z plane of a wire antenna for circularly polarized wave of the invention.
Figure 6:
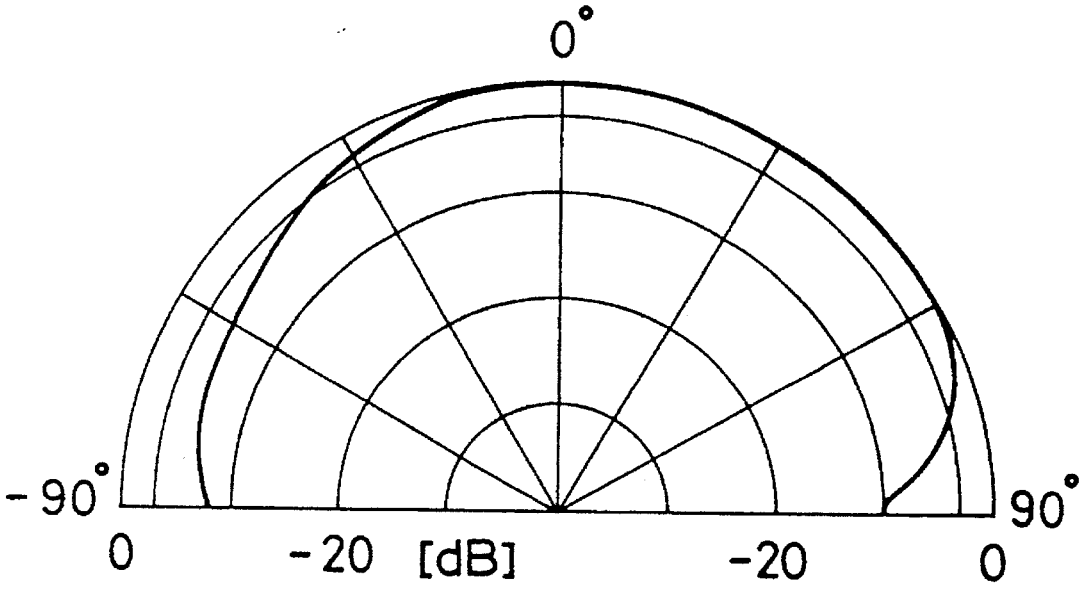
FIG. 6 is a graph showing a radiation pattern of Y-Z plane of a wire antenna for circularly polarized wave of the invention.

Characteristics of the above constructed antenna are shown in FIGS. 2 to 6. FIG. 2 shows a characteristic of a voltage standing wave ratio (VSWR) of the antenna. FIG. 3 shows its axial ratio characteristic. FIG. 4 illustrates a measurement coordinate system of the antenna. FIG. 5 illustrates a radiation pattern of X-Z plane. FIG. 6 shows its radiation pattern of Y-Z plane.

These data show what degree of circularly polarized waves the antenna radiate. For example, it is understood that the antenna radiates good circularly polarized waves of the axial ratio of 6 dB, a bandwidth of 6 per cent or more, and a half power of 120 degrees. It is also understood that an electric field is maximum at a bore site direction of the antenna 1 in view of the radiation directivity.

Figure 7:
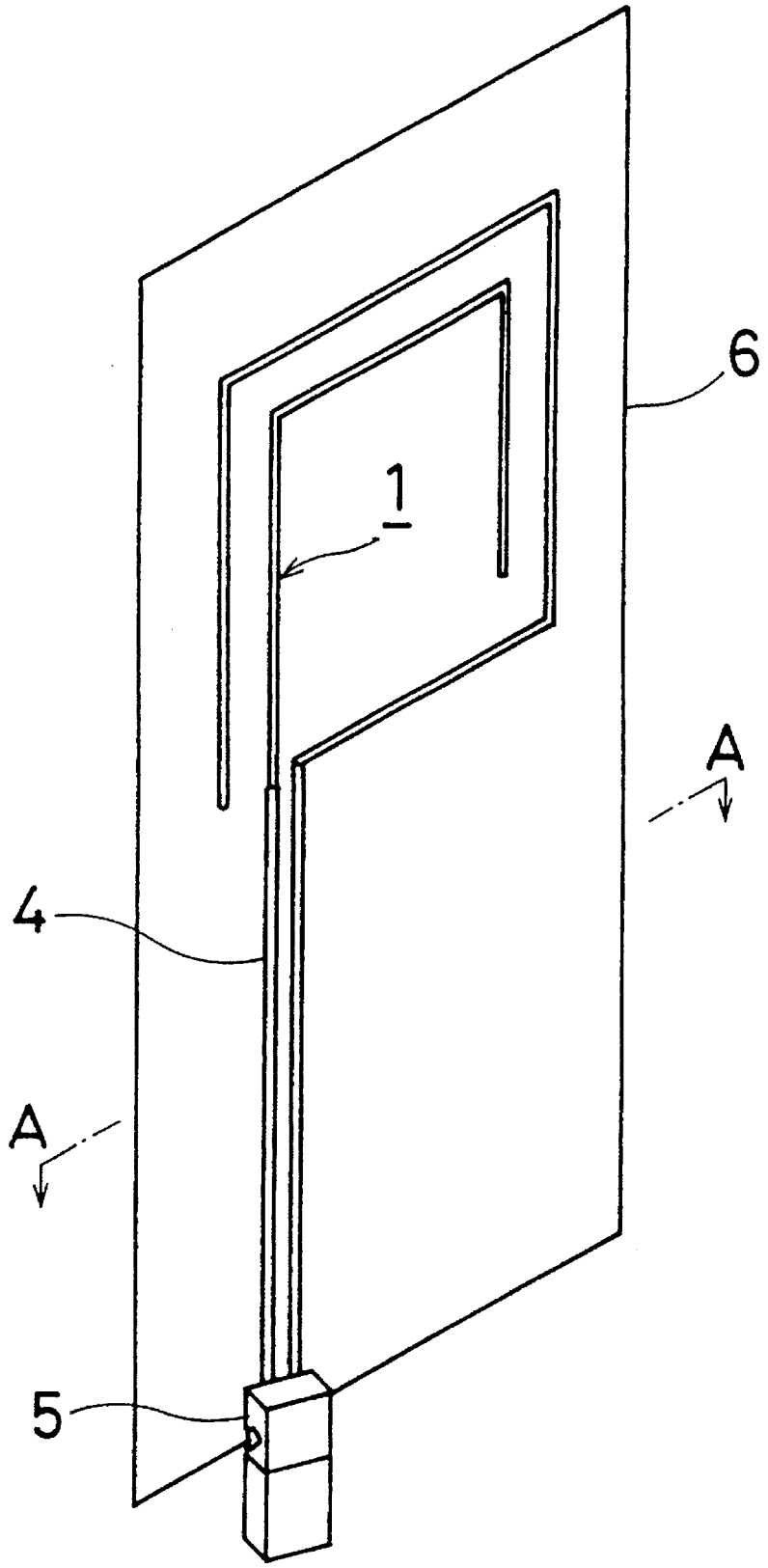
FIG. 7 is a perspective view showing an example of a way of fitting of one embodiment of a wire antenna for circularly polarized wave of the invention FIG. 8(*a*) is a sectional view showing an example of a section of a wire antenna for circularly polarized wave taken along the line VIII—VIII of FIG. 7.
Figure 8A:
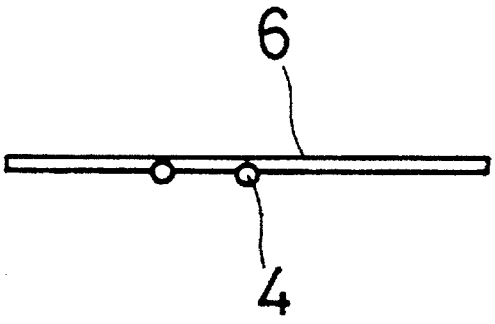
FIG. 8(*b*) is a sectional view showing another example of a section of a wire antenna for circularly polarized wave taken along the line VIII—VIII of FIG. 7.
Figure 8B:
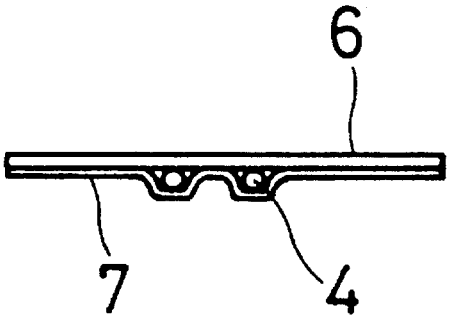

Next, an example of way of fitting the present embodiment of the antenna is described referring to FIG. 7 and FIG. 8.

As shown in the figures, parallel feed line 4 is connected with the feeding terminals 2*a* and 2*b*. The feed line 4 is electrically connected with a connector 5. A predetermined impedance matching is made between them. The feed line 4 is disposed as shown in FIG. 8(*a*) and FIG. 8(*b*), for example. Namely, FIG. 8(*a*) shows the feed line 4 welded to a film 6. FIG. 8(*b*) shows the feed line 4 sandwitched between the film 6 and an adhesive film 7. In the present embodiment, the feed line 4 is arranged planarly on the film 6 as well as the elements 3*a* and 3*b* and the feeding terminals 2*a* and 2*b*.

Figure 9A:
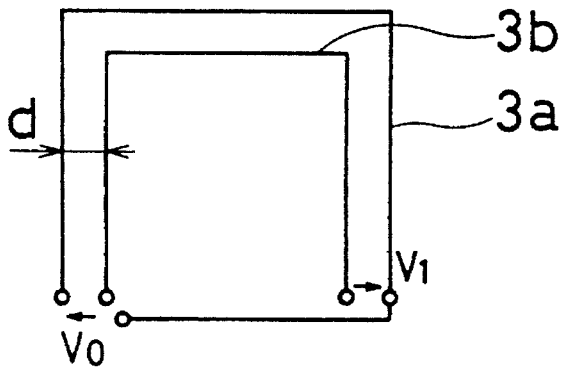
FIG. 9(*a*) is a front view showing a basic shape of one embodiment of a wire antenna for circularly polarized wave of the invention.
Figure 9B:
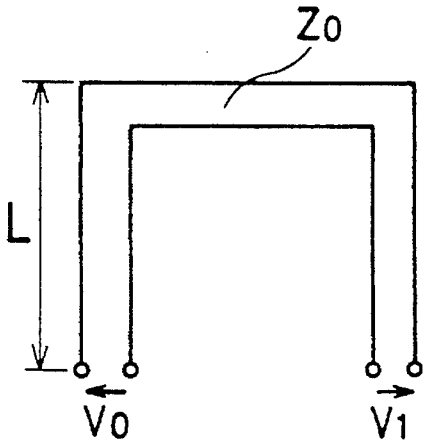
Figure 9C:
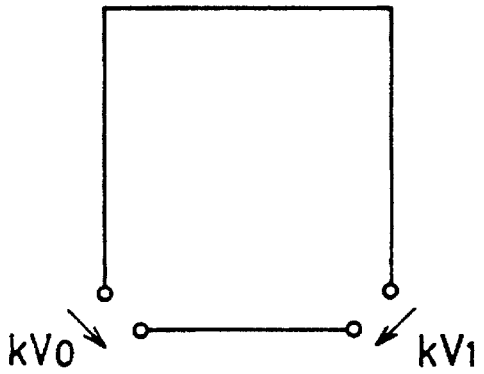

A principle of operation of the antenna 1 is explained referring to FIG. 9. The antenna 1 shown in FIG. 9(*a*) is decomposed into a balanced system shown in FIG. 9(*b*) and an unbalanced system shown in FIG. 9(*c*).

A characteristic impedance Z0 of a line of the balanced system of the antenna 1 is:

$$Z0=120\ln(d/a) \quad [\Omega]$$

Here, the symbol a shows a radius of the element, and the symbol d shows the distance between the outer element 3*a* and the inner element 3*b*.

On the other hand, a coefficient k multiplied by voltages of the unbalanced system is a voltage distribution factor. Since a left-handed circularly polarized wave can be generated by giving equal amplitude and 90 degrees of phase difference to the voltages of FIG. 9(*c*):

$$v_1/V0=-j$$

This can be realized via a transmission line of FIG. 9(*b*) as follows:

$$L\cong\lambda 0/4$$

$$Z0\cong R/k^2$$

Here, the symbol R shows an input resistance of a single loop element.

As described above, the present embodiment of the antenna is composed of the outer element 3*a* of one turn and the inner element 3*b* of three-fourths turn. Namely, the antenna 1 is defined by the loop conductor of the rectangular shape both ends of which are separated and which has an overall length of about 7/4λ0 and is 7/4 turn loop. Moreover, the feeding terminals 2*a* and 2*b* as the feed point is positioned at the one turn point of the loop conductor.

In resume, the feeding terminals 2*a* and 2*b* are arranged at one turn point of the rectangular and open shaped elements 3*a* and 3*b* or the loop conductor that has the entire length of 7/4λ0 and is 7/4 turn loop.

Accordingly, all the parts, namely the elements 3*a* and 3*b* (loop conductor), feeding terminals 2*a* and 2*b* and the feed line 4 can be disposed in the same plane on the film 6, as shown in FIG. 7. Thus, the antenna 1 can be planar shape and thin, that is suitable for mobiles like cars. Moreover, it is unnecessary for the antenna 1 to add a perturbation element on the way of the loop, so that a soldering step can be omitted and that there is no need for a dielectric substrate of high frequency characteristic that is required in prior art and very expensive. Namely, the antenna 1 is a cheap wire antenna of a simple construction and appropriate to mass production.

While the elements 3*a* and 3*b* of the loop conductor have a rectangular shape, they may be alternately be another shape, as long as the element 3*a* is one turn and the element 3*b* is 3/4 turn.

The preferred embodiments described herein are therefore illustrative and not restrictive, the scope of the invention being indicated in the appended claims and all variations which come within the meaning of the claims are intended to be embraced therein.

What is claimed is:

1. A wire antenna for a circularly polarized wave comprising:

a first conductor element having a length of approximately one wave length of said wave, said first conductor element being disposed in an open loop with first and second ends of said first conductor element being spaced apart;

a second conductor element having a length of approximately 3/4 wave length of said wave, said second conductor element being disposed in an open loop with first and second ends of said second conductor element being spaced apart with said first end of the second conductor element positioned adjacent said second end of said first conductor element;

said first and second conductor elements being associated with each other so that said first and second elements define a loop conductor being a substantially 7/4 turn of an open loop having an overall length of approximately 7/4 wave length; and a first feed point disposed at the second end of said first conductor element and a second feed point disposed at the first end of said second conductor element.

2. A wire antenna for a circularly polarized wave according to claim 1, in which the first and second elements of the loop conductor are disposed on and joined to a film.

3. A wire antenna for a circularly polarized wave according to claim 2, further comprising a feed line disposed on and joined to a film, the feed line having an end electrically connected with the feed points of the loop conductor.

4. A wire antenna for a circularly polarized wave according to claim 1, in which the first element has a substantially rectangular loop shape and the second element has a channel shape having a base connected to two arms with space therebetween that is disposed substantially parallel inside the first element with a distance therebetween.

5. A wire antenna for a circularly polarized wave according to claim 4, in which a constant distance is formed in a circumferential direction between the first element and the second element, and a fixed distance is held between an other end of the second element and the first element.

6. A wire antenna for a circularly polarized wave according to claim 1, the first element and the second element of the loop conductor are made of wires.

7. A wire antenna for a circularly polarized wave according to claim 1, in which the wire antenna radiates a circularly polarized wave upon application of power at said first and second feed points.

8. A wire antenna for a circularly polarized wave comprising:

a first conductor element having a length of approximately one wave length of said wave, said first conductor element being disposed in an open loop with first and second ends of said first conductor element being spaced apart;

a second conductor element having a length of approximately ¾ wave length of said wave, said second conductor element being disposed in an open loop with first and second ends of said second conductor element being spaced apart with said first end of the second conductor element positioned adjacent said second end of said first conductor element;

said first and second conductor elements being associated with each other to form a loop conductor so that said loop conductor defines a substantially ⅞ turn of an open loop having a rectangular configuration with opposite ends separated; and a first feed point disposed at the second end of said first conductor element and a second feed point disposed at the first end of said second conductor element.

9. A wire antenna for a circularly polarized wave according to claim 8, in which the wire antenna radiates a circularly polarized wave upon application of power at said first and second feed points.

10. A wire antenna for a circularly polarized wave according to claim 8, in which the wave length is $\lambda_0$, wherein the second element is disposed within the first element, and said first and second elements are separated by a distance of approximately $0.016\lambda_0$, the second end point of the second element being separated from the first element by a distance of approximately $0.026\lambda_0$, and a length of a side of the first element forming the open loop having a rectangular shape being approximately $0.27\lambda_0$.

* * * * *